US005430694A

United States Patent [19]

Perrot

[11] Patent Number: 5,430,694

[45] Date of Patent: Jul. 4, 1995

[54] TIMEPIECE

[75] Inventor: Friedrich Perrot, Lengnau, Switzerland

[73] Assignee: Eta SA Fabriques d'Ebauches, Grenchen, Switzerland

[21] Appl. No.: 79,773

[22] Filed: Jun. 22, 1993

[30] Foreign Application Priority Data

Jun. 30, 1992 [CH] Switzerland ..... 02043/92

[51] Int. Cl.[6] ..... G04B 37/00; G04C 23/02

[52] U.S. Cl. ..... 368/88; 368/10; 368/236; 368/300; 368/314; 368/316; 368/318; 368/327

[58] Field of Search ..... 368/88, 10, 76, 276–282, 368/297–300, 309–318, 327

*Primary Examiner*—Bernard Roskoski

*Attorney, Agent, or Firm*—Pollock, Vande Sande & Priddy

[57] ABSTRACT

The timepiece comprises a base part (1) of plastic material, at least one element (2) secured to said base part and securing means for said element onto said base part which comprise a stud (34) driven at one of its ends (40) into a through hole (32) in the base part (1). The other end (12) of the stud (34) is fitted into a hole (10) of the element (2) and is upset against the latter so as to form a rivet. Finally the base part (1) is fashioned in a manner to permit access to the driven end (40) of the stud with a tool (A) furnishing a rigid support under the stud during the riveting operation on the other end (12) of the latter.

10 Claims, 2 Drawing Sheets

TIMEPIECE

FIELD OF THE INVENTION

The invention concerns a timepiece comprising a base part of soft material, in particular plastic material, and at least one element rigidly secured onto such base part.

The invention more specifically concerns securing means permitting attaching a multifunctional element, such as a bridge, onto a base part of plastic material forming a base plate.

BACKGROUND OF THE INVENTION

In horology, securing means permitting rigid attachment of one part onto another, must be as compact as possible in order that the resulting assembly exhibit a space requirement reduced as much as possible. When the resulting assembly must be reliable and resist tearing away caused by strong stresses while the base part which forms the support is a plastic material or, more generally, of a material substantially softer than brass, most of the traditional securing methods cannot be used in a satisfactory manner.

The use of rivets is particularly suitable for the assembly of timepieces within the framework or high mass production.

Nevertheless, securing by metallic rivets is often impossible to practice when the base part, in particular the base plate which must receive such rivet, is of plastic material. Effectively, the pressure which must be exerted on the rivet in order to upset the head and to form the riveting is sufficient to deform the plastic material of the base plate in an unacceptable manner.

Another technique currently used for securing an element onto a base part of plastic material calls for studs which are integral with the material of the base part, in particular the base plate of plastic material and which project normally to the surface of the latter. Such studs are introduced into corresponding holes formed in the element which it is desired to secure to the base part. Once the element is thus placed in the desired position on the said base part, the free ends of the studs are plastically deformed, for example by means of an ultrasonic technique in order to upset them and form a plastic riveting. The rivets produced by this technique being thus of plastic material, the assemblies obtained once again do not offer sufficient rigidity for certain applications.

Finally, the use of screws besides its relatively high cost price presents the drawback of not always enabling the obtention of sufficiently compact assemblies. Effectively, the heads of the screws form projecting portions going beyond the assembly.

A purpose of the present invention is to overcome the drawbacks of the prior art which have just been described in furnishing securing means exhibiting a relatively small space requirement capable of being put into place in a part of plastic material and permitting production of extremely rigid assemblies.

SUMMARY OF THE INVENTION

To this end, the invention has as objective a timepiece provided with securing means comprising a stud, one of the ends of which is driven or inserted into a hole in a part of plastic material and the other end of which is upset against the element to be secured in order to form a riveting. The hole formed in the part of plastic material is shaped so as to permit access to the driven in (or inserted) end of the stud by a tool in order to form a support enabling riveting of said stud without the part of plastic material being subjected to damaging stresses.

A specific embodiment of the invention is set forth in a detailed manner hereinafter with the help of the attached drawings given by way of example.

DESCRIPTION OF THE PREFERRED EMBODIMENT

In referring to the annexed drawings, there will be described hereinafter a timepiece according to the invention, designated by the general reference H and comprising a base plate 1 shown schematically by its contour in interrupted mixed dashes.

Figure 1:
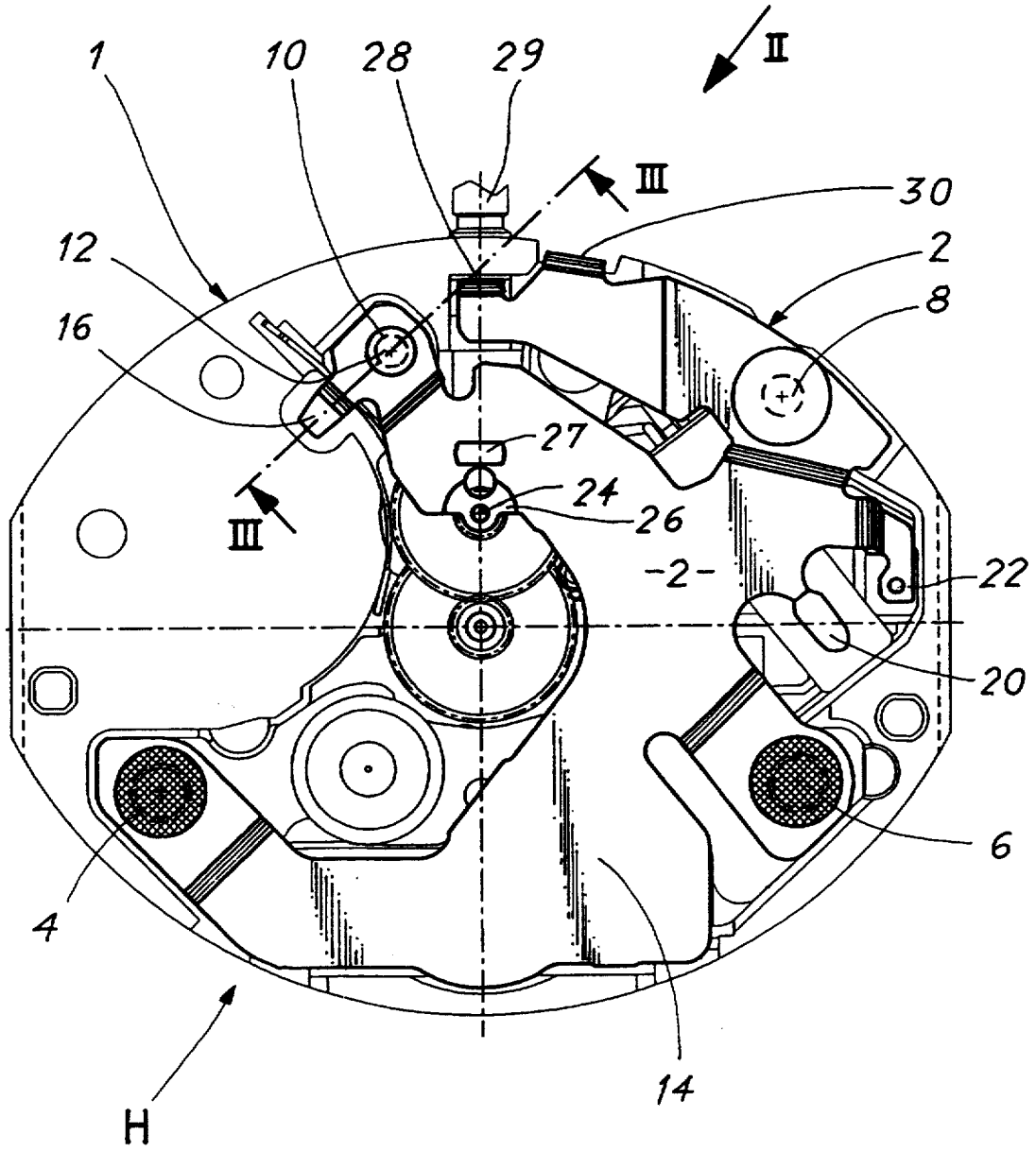
FIG. 1 is a top view of a multifunctional element of a timepiece according to the invention secured onto the base plate of a watch movement.

As is seen on FIG. 1, the timepiece H includes a multifunctional element 2 of metal secured onto a base part 1 formed in this example by the base plate of an electronic movement. Base plate 1 which is formed of a plastic material such as P.P.S. (polyphenylsiloxane) or polycarbonate is obtained preferably by moulding while bridge 2 is obtained by stamping from a sheet of small thickness. As is seen on FIG. 3, base plate 1 includes two surfaces referred to respectively as the upper surface 1*a* and lower surface 1*b* with reference to the position of base plate 1 such as shown on such figure, that is to say, in the position of use with the hands (not shown) directed towards the top. The functional element 2 is secured onto base plate 1 on its upper surface 1*a*, preferably with the help of studs of plastic material (not shown), integral with the material of base plate 1 and being riveted by ultrasonic means at the level of two holes 4 and 6 and by a stud (not shown) inserted at the level of hole 8 provided in element 2. Element 2 could be secured at such places by other means known to the man skilled in the art. The multifunctional element 2 further comprises a hole 10 provided in order to receive a first end 12 (referred to as upper end) of a securing stud 34 shown in detailed fashion on FIG. 3, such stud 34 being intended to provide a particularly rigid fastening at this place for element 2 on the base part or base plate 1 for reasons which will be understood hereinafter.

Figure 2:
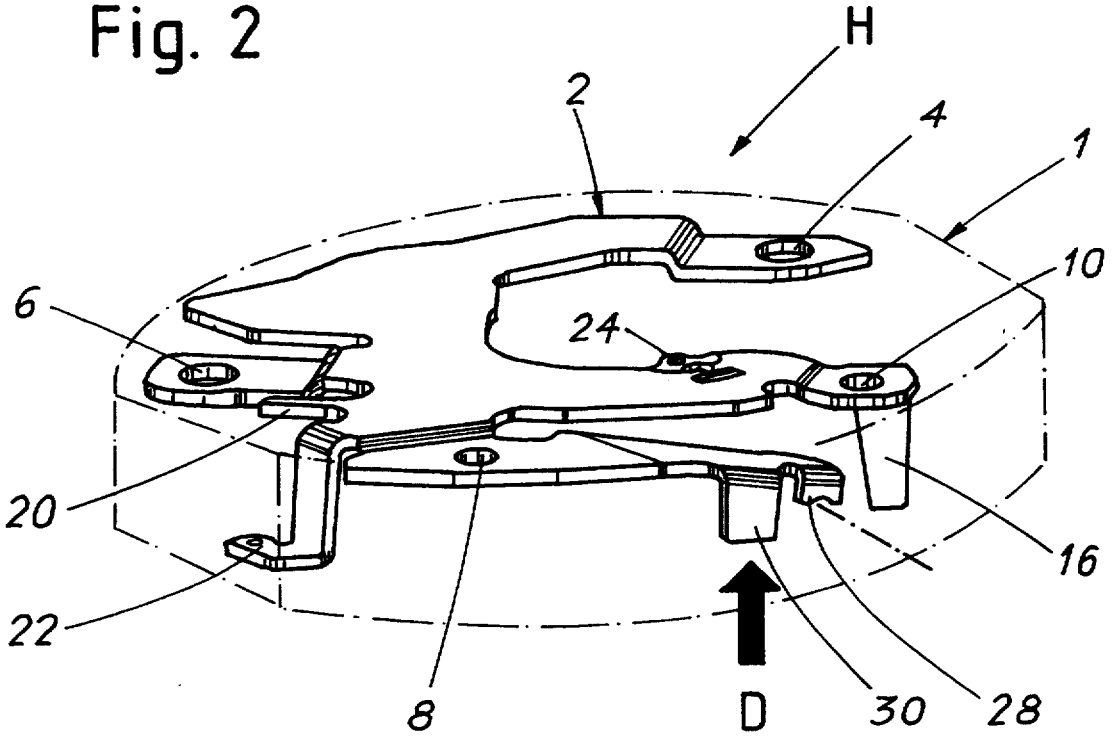
FIG. 2 is a perspective view of the multi-functional element taken according to arrow II of FIG. 1 and showing more specifically a releasing arm for a stem.

In this example, element 2 fulfils several functions. Among others, the portion of bridge 2 referenced by 14 on FIG. 1 covers over a winding (not shown) which is housed in a cavity (not shown) of base plate 1. Element 2 equally fulfils a function as electrical conductor since it includes a clamp 16 provided to be brought into contact by lateral support on the positive pole of a cell 18 (FIG. 3) which is housed in a cavity 19 (FIG. 3) formed in base plate 1. Element 2 includes two clamps 20 and 22 which are respectively connected to the casing of the quartz (not shown) and to the positive terminal of an electronic module (likewise not shown) which are thus coupled to the positive pole of cell 18. Element 2 further comprises an orifice 24 which serves to guide a dial train peg, element 2 thus also forming a guiding bridge for the wheel works. The hole 24 is formed at the center of a circular depression 26 of bridge 2. A second depression referenced 27 (FIG. 1) fulfils a support function for the minutes wheel. As is seen on FIG. 1 and in greater detail on FIG. 2, the multifunctional element 2 further includes a catch for a stem 29 (FIG. 1), such catch which bears the reference 28 being formed of a blade bent over at 90° relative to the main plane of the multifunctional bridge forming element 2. Catch 28 is provided in order to be brought into cooperation at its end with circular grooves (not shown) on stem 29 in order to assure the stable maintenance in different positions of the stem. At the side of catch 28 there is also formed on element 2 an arm 30 intended to permit the releasing of stem 29. When pressure is exerted on the release arm 30 in the sense of arrow D (FIG. 2), there results bending of element 2 forming the bridge in the region thereof situated between the release arm 30 and hole 8. This bending enables releasing of catch 28 from the circular grooves of stem 29. In such position, stem 29 can slide freely in order to be taken out of timepiece 1 or in order to be reintroduced into the latter, this operation being necessary each time that it is wished to introduce the timepiece into a case or remove it therefrom.

The stem releasing functions (arm 30) and guiding of the dial train peg (hole 24) being assured by two neighbouring parts arranged on the same element 2, the deformation of bridge forming element 2 produced by the operation of the release arm 30 may bring about a mechanical stress in the neighbourhood of orifice 24 which serves to guide the dial train peg. Furthermore, pulling on the stem during time setting, for example, also produces through catch 28 mechanical stresses in the neighbourhood of hole 24. Such stresses may bring about a displacement of the dial train peg and thus perturb operation of the timepiece H.

But above all, the clamp 16 is also proximate hole 24 and there is thus also a risk of displacement of hole 24 because of the pressure of cell 18 on clamp 16.

To prevent such risk and to assure that the guide hole 24 is not displaced from its position, there are employed particularly resistant securing means in order to secure bridge forming element 2 to base plate 1 in a rigid manner at the level of hole 10, that is to say, very close to tile dial train peg guiding hole 24. Such particularly rigid securing means are the object of the present invention.

Figure 3:
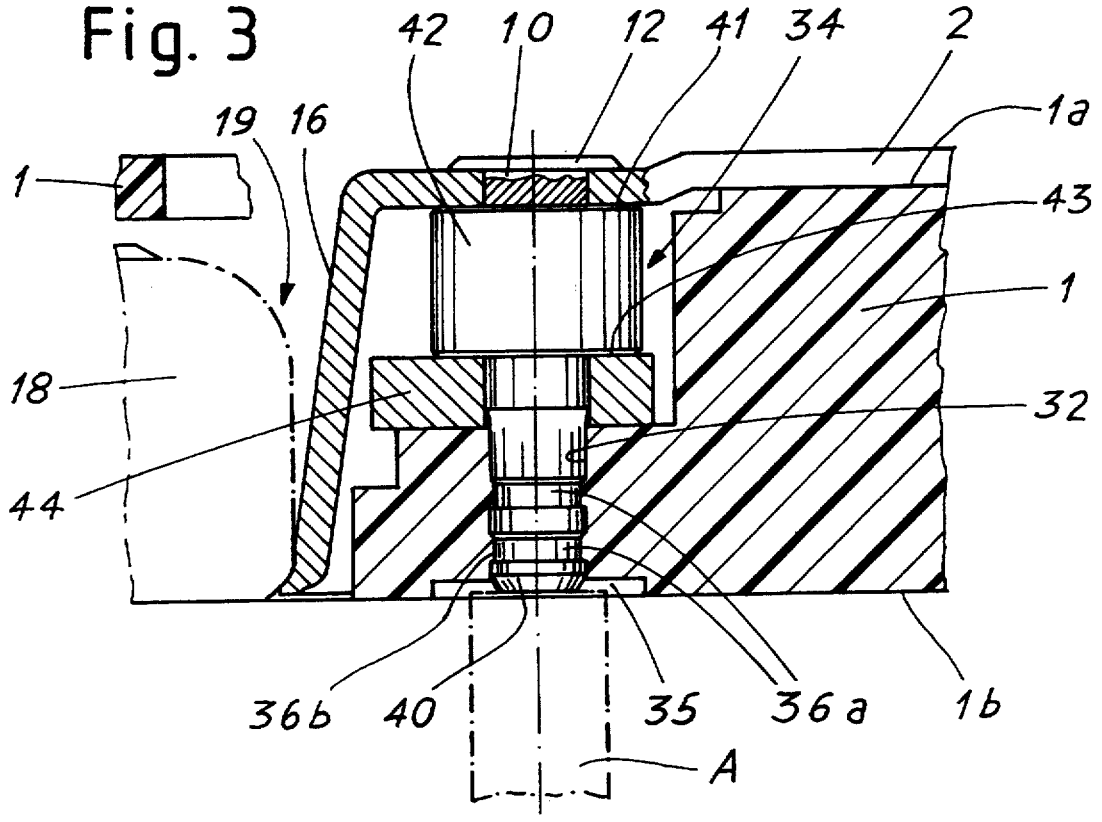
FIG. 3 is a cross-section taken along line III—III of FIG. 1 showing the securing means according to the present invention.

As is seen on FIG. 3, the securing means according to the invention include a stepped stud 34 which is anchored by force mounting or inserted, for example, by ultrasonic means at a second end 40, referred to as lower end, or driven into a through hole 32 in base plate 1. It will be understood that the expression "driven" is intended to include equally force fitting and ultrasonic insertion. The stepped stud 34 and more specifically the anchoring end 40 includes one or several circular grooves **36*a* in which penetrate respectively one or several flanges 36*b* in order to increase rigidity of the assembly. Flanges 36*b* are formed by plastic deformation of base plate 1 and in particular by plastic flow of its material during assembly of stud 34 in hole 32. The end 12 of stud 34 forms a rivet head which is upset against the element forming bridge 2 in order to form a riveting once the stud 34 has been driven into base plate 1 and after tool A has been put into place against the driven and emerging end 40 of stud 34. The through hole 32 also includes a hollow or counterbore 35 formed in the lower surface 1*b* of base plate 1 and forming an enlarged hollowed-out zone which is situated at its lower end. This configuration enables at the driven-in lower end 40 of stud 34 to emerge at the exterior of such hollow 35 without nevertheless projecting from the lower surface 1*b* of base plate 1 and thus enables access thereto with a tool A, shown schematically on FIG. 3, directly to said end 40 of stud 34 which provides a rigid support on which stud 34 may be brought to rest at the tip by such driven-in end 40 during the riveting operation. It is seen from what precedes that the configuration of stud 34 and that of the through hole 32 enable exerting the necessary axial pressure on stud 34 to upset its upper end 12 and form the corresponding riveting, such stress being exerted directly on the two ends of stud 34 without causing the base plate 1 to be subjected to stresses. Furthermore, the stud 34 comprises preferably at least one shoulder 41 formed by the upper edge of a part 42 thereof constituted by a bulge proximate the head of rivet 12 and possessing a diameter greater than that of hole 10 in bridge 2, the shoulder 41 constituting an axial support on which the element forming bridge 2 is here brought to rest directly. With this arrangement the element forming bridge 2 is squeezed between the head of the rivet and the shoulder 41. Once the stud 34 has been driven into the through hole 32 and the upper end 12 of the stud riveted onto bridge 2, the element forming bridge 2 is secured in an extremely rigid manner onto base plate 1. Effectively, stud 34 is directly riveted onto the element forming bridge 2 while stud 34** itself is anchored in the base plate over a major portion of its length.

Stud 34 may also exhibit a second shoulder 43 formed by the lower edge of said enlarged portion or bulge 42 which thus constitutes a spacer which determines the spacing between the surface of the base element or base plate 1 and bridge 2 upon positioning the securing stud 34. The presence of shoulder 43 additionally permits, as is the case in the embodiment shown, to use stud 34 likewise to assure the securing of a second part 44 onto base plate 1. In this case, part 44 which for example is formed by a framework supporting the wheel train, not shown, is held gripped between shoulder 43 and base plate 1.

The several remarks which follow have as purpose to facilitate forming the assembly which has just been described. Initially, the through hole 32 and the hollow 35 in the base part of plastic material 1 are preferably formed during moulding of said base part 1. On the other hand, at the moment of assembly of the elements, it is preferable to drive the end 40 of the securing stud 34 into the base plate before placing bridge 2 on the latter. Finally, the riveting operation is preferably accomplished last, once the multifunctional part 2 is in place resting on the surface **1*a* of the base plate and on shoulder 41 of the spacer 42. In order to permit accomplishment of this latter operation, a tool A is initially put into place against the emerging end 40 of stud 34 in order to provide the latter with a rigid support. Then the upper end 12 of stud 34** is upset in order to form the riveting.

What is claimed is:

1. A timepiece comprising a base part of plastic material, at least one element, and securing means for securing said element onto said base part, said securing means comprising a unitary stud having a first end zone and a second end zone, and two substantially coaxial through holes formed respectively in said element and in said base part, said second end zone of said unitary stud being unrealeasably embedded in said through hole in said base part and said first end zone being partially disposed into said through hole in said element and comprising a first portion formed by a bulge having a cross-sectional area substantially greater than the cross-sectional area of the through hole formed in said element and providing at least one supporting surface, and a second portion unrealeasably upset against said element so as to form a head fixedly engaging said element and thereby maintaining said base part and said element in a fixed, unreleasable relation.

2. A timepiece as set forth in claim 1, wherein the second end zone of said stud includes at least one circular groove provided to cooperate with an interior surface of said through hole in the base part.

3. A timepiece as set forth in claim 1, wherein said through hole in the base part includes an enlargement at an outer end in order to provide clearance around said second end zone of the stud for access thereto by a tool for causing said unreleasable upset.

4. A timepiece as set forth in claim 1, further comprising at least one second element provided with a through hole receiving the stud, said bulge having a shoulder exhibiting a cross-sectional area greater than that the said through hole in said second element in order to grip said second element between said shoulder and said base part.

5. A timepiece as set forth in claim 1, wherein said stud is made of metal.

6. A timepiece comprising a base part of plastic material, at least one element, and securing means for securing said element onto said base part, said securing means comprising a unitary stud having a first end zone and a second end zone, and two substantially coaxial through holes formed respectively in said element and in said base part, said second end zone of said unitary stud being unrealeasably embedded in said through hole in said base part and said first end zone being partially disposed into said through hole in said element and comprising a first portion having at least one supporting surface and a second portion unreleasably upset against said element so as to form a head fixedly engaging said element and thereby maintaining said base part and said element in a fixed, unreleasable relation, and the second end zone of said stud including at least one circular groove provided to cooperate with an interior surface of said through hole in the base part.

7. A timepiece as set forth in claim 6, wherein said stud is made of metal.

8. A timepiece as set forth in claim 6, wherein said through hole in the base part includes an enlargement at an outer end in order to provide clearance around said second end zone of the stud for access thereto by a tool for causing said unreleasable upset.

9. A timepiece as set forth in claim 6, wherein said supporting surface is formed as a shoulder of a bulge, which has a diameter substantially greater than the diameter of the through hole formed in said element and on which said element rests axially.

10. A timepiece as set forth in claim 9, further comprising at least one second element provided with a through hole receiving the stud, said bulge having a second shoulder exhibiting a diameter greater than that of said through hole in said second element in order to grip said second element between said second shoulder and said base part.

* * * * *

UNITED STATES PATENT AND TRADEMARK OFFICE

CERTIFICATE OF CORRECTION

PATENT NO. : 5,430,694
DATED : July 4, 1995
INVENTOR(S) : Friedrich Perrot

It is certified that error appears in the above-indentified patent and that said Letters Patent is hereby corrected as shown below:

On the title page: Item [56] Foreign Patent Documents should be inserted to read --

80 25 389 01/87 Germany
370 708 07/63 Switzerland --.

Signed and Sealed this

Nineteenth Day of December, 1995

*Attest:*

Bruce Lehman

BRUCE LEHMAN

*Attesting Officer*

*Commissioner of Patents and Trademarks*